US010852701B2

(12) United States Patent
Hasegawa et al.

(10) Patent No.: US 10,852,701 B2
(45) Date of Patent: Dec. 1, 2020

(54) ELECTRONIC TIMEPIECE, INFORMATION OBTAINING CONTROL METHOD AND STORAGE MEDIUM

(71) Applicant: CASIO COMPUTER CO., LTD., Tokyo (JP)

(72) Inventors: Kosuke Hasegawa, Koganei (JP); Yuki Oshita, Tokyo (JP); Mitsuaki Matsuo, Fussa (JP); Akihiro Kuroha, Fussa (JP); Shimpei Matsuda, Kunitachi (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 380 days.

(21) Appl. No.: 15/903,224

(22) Filed: Feb. 23, 2018

(65) Prior Publication Data

US 2018/0246475 A1 Aug. 30, 2018

(30) Foreign Application Priority Data

Feb. 27, 2017 (JP) ..... 2017-034396

(51) Int. Cl.
*G04R 20/02* (2013.01)
*G04R 20/26* (2013.01)

(52) U.S. Cl.
CPC ..... *G04R 20/02* (2013.01); *G04R 20/26* (2013.01)

(58) Field of Classification Search
CPC ..... G04R 20/02; G04R 20/04; G04R 20/06; G04R 20/26; G04R 20/28; G04R 20/30
See application file for complete search history.

(56) References Cited

U.S. PATENT DOCUMENTS

2010/0220555 A1* 9/2010 Honda ..... G04R 20/04 368/14

FOREIGN PATENT DOCUMENTS

EP 2 565 735 A2 3/2013
JP S53-110573 A 9/1978
(Continued)

OTHER PUBLICATIONS

Notice of Reasons for Refusal dated Jun. 11, 2019 in Japanese Patent Application No. 2017-034396.
(Continued)

*Primary Examiner* — Edwin A. Leon
*Assistant Examiner* — Jason M Collins
(74) *Attorney, Agent, or Firm* — Scully Scott Murphy & Presser

(57) ABSTRACT

An electronic timepiece, including: a receiver which receives broadcast radio waves including time information; a communicator which carries out wireless communication by establishing communication connection with an external device which is set; a processor; and an operation receiving unit which receives an input operation via an operating member, wherein in a case where a predetermined input operation corresponding to a command for obtaining information regarding a present time is received via a predetermined operating member, the processor selects a first information obtaining operation by which the information is obtained from the external device which is set via the communicator or a second information obtaining operation by which the information is obtained based on the broadcast radio waves received by the receiver according to whether a setting regarding the external device exists.

20 Claims, 6 Drawing Sheets

(56) References Cited

FOREIGN PATENT DOCUMENTS

| | | | |
|---|---|---|---|
| JP | 2010-078546 | A | 4/2010 |
| JP | 2013-050341 | A | 3/2013 |
| JP | 2014-182062 | A | 9/2014 |
| JP | 2015-172523 | A | 10/2015 |
| JP | 2015-184102 | A | 10/2015 |
| JP | 2016-164531 | A | 9/2016 |
| JP | 2016-164533 | A | 9/2016 |

OTHER PUBLICATIONS

Extended European search report dated Aug. 8, 2018 received in European Patent Application No. EP 18158020.0.

* cited by examiner

ELECTRONIC TIMEPIECE, INFORMATION OBTAINING CONTROL METHOD AND STORAGE MEDIUM

BACKGROUND OF THE INVENTION

1. Field of the Invention

The present invention relates to an electronic timepiece, an information obtaining control method and a storage medium.

2. Description of Related Art

Conventionally, there has been an electronic timepiece which can obtain date and time information by receiving wireless radio waves from outside and which can maintain the accurate date and time by correcting the date and time which is counted by itself. As for the radio waves which are the targets from which the date and time information is to be obtained, standard radio waves of low frequency band, radio waves from positioning satellites, radio waves used in close distance wireless communication with a portable type electronic terminal, and the like are widely used.

With respect to obtaining of date and time by receiving these various types of radio waves, each of the types of radio waves has advantages and disadvantages regarding the additional configuration needed for reception, receivable area, receiving time, power consumption and the like. Therefore, a preferred one is used or they are selectively used according to the cost, the area where the electronic timepiece is to be used (the area where the electronic timepiece is to be sold), and the like.

Further, as disclosed in in Japanese Patent Application Laid Open Publication No. 2010-78546 which is a Japanese patent document, for example, in an electronic timepiece which can receive radio waves from a positioning satellite, there is a case where only the date and time information is obtained and there is a case where the location information is also obtained with the date and time information. In such electronic timepiece, whether the location information is to be obtained can be selected according to an input operation which is performed by a user.

However, operating members such as push button switches which receive operations and the like are limited in such electronic timepiece and the operation can be complicated if the operation selections increase. Especially, depending on the situation, when an operation for selecting a configuration where obtaining of date and time is difficult is universally included in the operation selections, it is inefficient since more time and processes are needed because unnecessary operation has to be done before carrying out a desired selecting.

SUMMARY OF THE INVENTION

There are disclosed an electronic timepiece, an information obtaining control method and a storage medium.

According to a preferred embodiment of the present invention, there is provided an electronic timepiece, including: a receiver which receives broadcast radio waves including time information; a communicator which carries out wireless communication by establishing communication connection with an external device which is set; a processor; and an operation receiving unit which receives an input operation via an operating member, wherein in a case where a predetermined input operation corresponding to a command for obtaining information regarding a present time is received via a predetermined operating member, the processor selects a first information obtaining operation by which the information is obtained from the external device which is set via the communicator or a second information obtaining operation by which the information is obtained based on the broadcast radio waves received by the receiver according to whether a setting regarding the external device exists.

BRIEF DESCRIPTION OF THE DRAWINGS

The above and other objects, advantages and features of the present invention will become more fully understood from the detailed description given hereinafter and the appended drawings which are given by way of illustration only, and thus are not intended as a definition of the limits of the present invention, and wherein.

DETAILED DESCRIPTION OF THE PREFERRED EMBODIMENT

Hereinafter, an embodiment will be described on the basis of the drawings.

Figure 1:
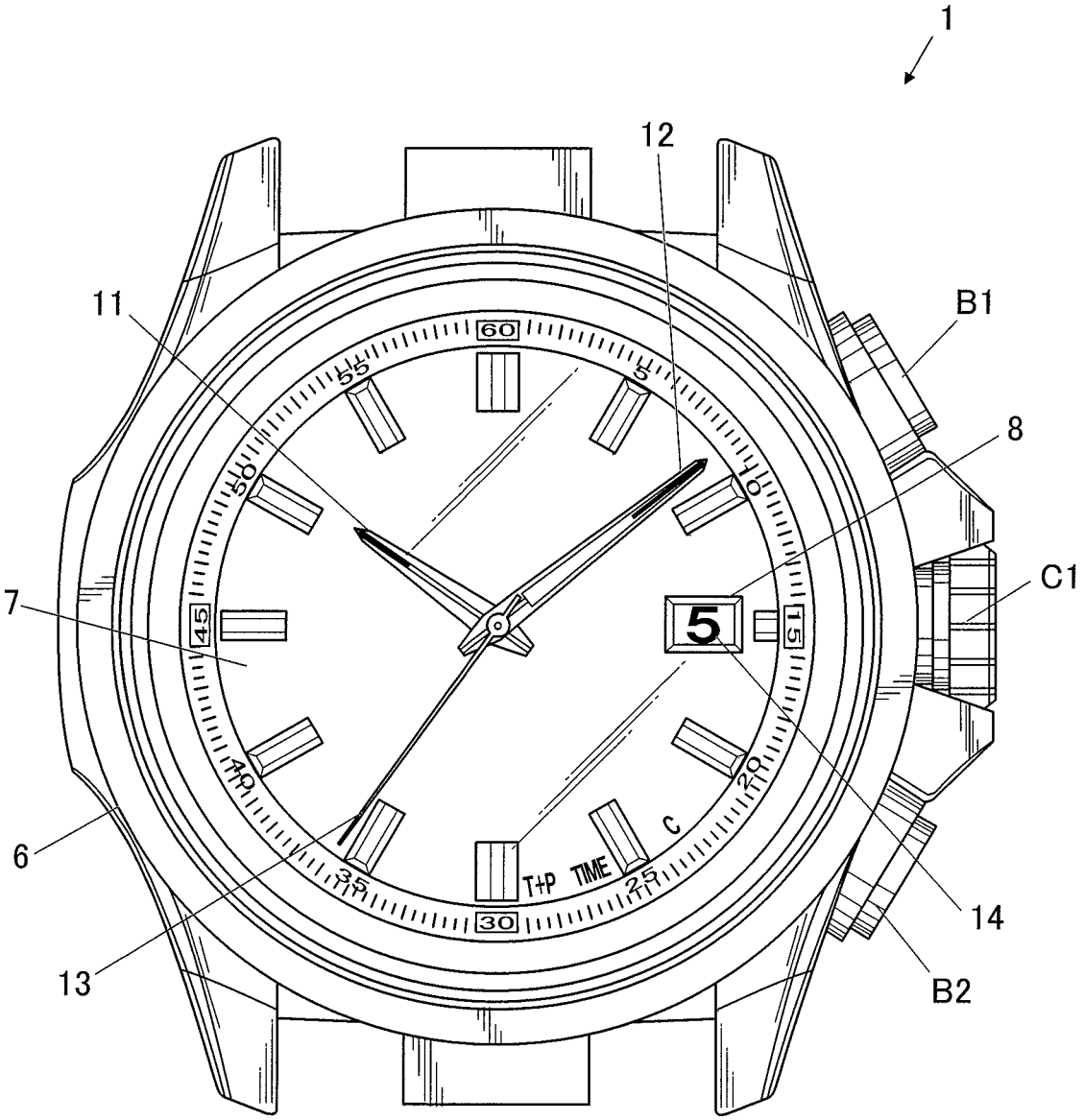
FIG. 1 is a front view illustrating an electronic timepiece according to an embodiment of the present invention.

FIG. 1 is a front view illustrating the electronic timepiece 1 according to an embodiment of the present invention.

The electronic timepiece 1 of the embodiment is an electronic wrist watch which can display the date and time by four hands including the date wheel 14 which is a rotating disk. The electronic timepiece 1 includes a casing 6, a dial 7 and such like. There is also provided an hour hand 11, a minute hand 12 and a second hand 13 between the dial 7 and a wind-proof glass (not shown) which covers the upper face (front face). Further, the date wheel 14 is disposed on the under surface side of the dial 7 (on the side of the dial 7 that is opposite of the side facing the wind-proof glass (the exposed surface side)) so as to be approximately parallel to the dial 7. The hour hand 11, the minute hand 12, the second hand 13 and the date wheel 14 are disposed so as to rotate by sharing the axis at the center section of the dial 7 as the center. On the side of the casing 6, push button switches B1 and B2 and a crown C1 are disposed.

The upper surface side (the side facing the wind-proof glass) of the dial 7 includes indicators (characters which indicate time) and scales for indicating date and time. Further, the indicators "C", "TIME" and "T+P" are disposed on the dial 7, between the 4:00 direction and the 6:00 direction. These indicators indicate the condition regarding the radio wave reception from outside. The indicator "C" indicates a communication state by a communicator 55. The indicator "TIME" indicates an obtaining state of date and time information by the satellite radio wave receiving process unit 54. The indicator "T+P" indicates a positioning state by the satellite radio wave receiving process unit 54.

The date wheel 14 is a ring shaped rotating disk, and indicators "1" to "31" (date indicators) which indicate date are lined on the circumference thereof in an order having equal intervals therebetween. Due to rotating of the date wheel 14, the date is to be indicated by one date indicator being exposed through the opening 8 which is formed in the dial 7 in the 3:00 direction.

The push button switches B1 and B2 receive an operation by being pushed by a user. The crown C1 can be pulled out in two sections, and receives the pull out operations, the rotating operation while in the pulled out state and the push back operations.

Figure 2:
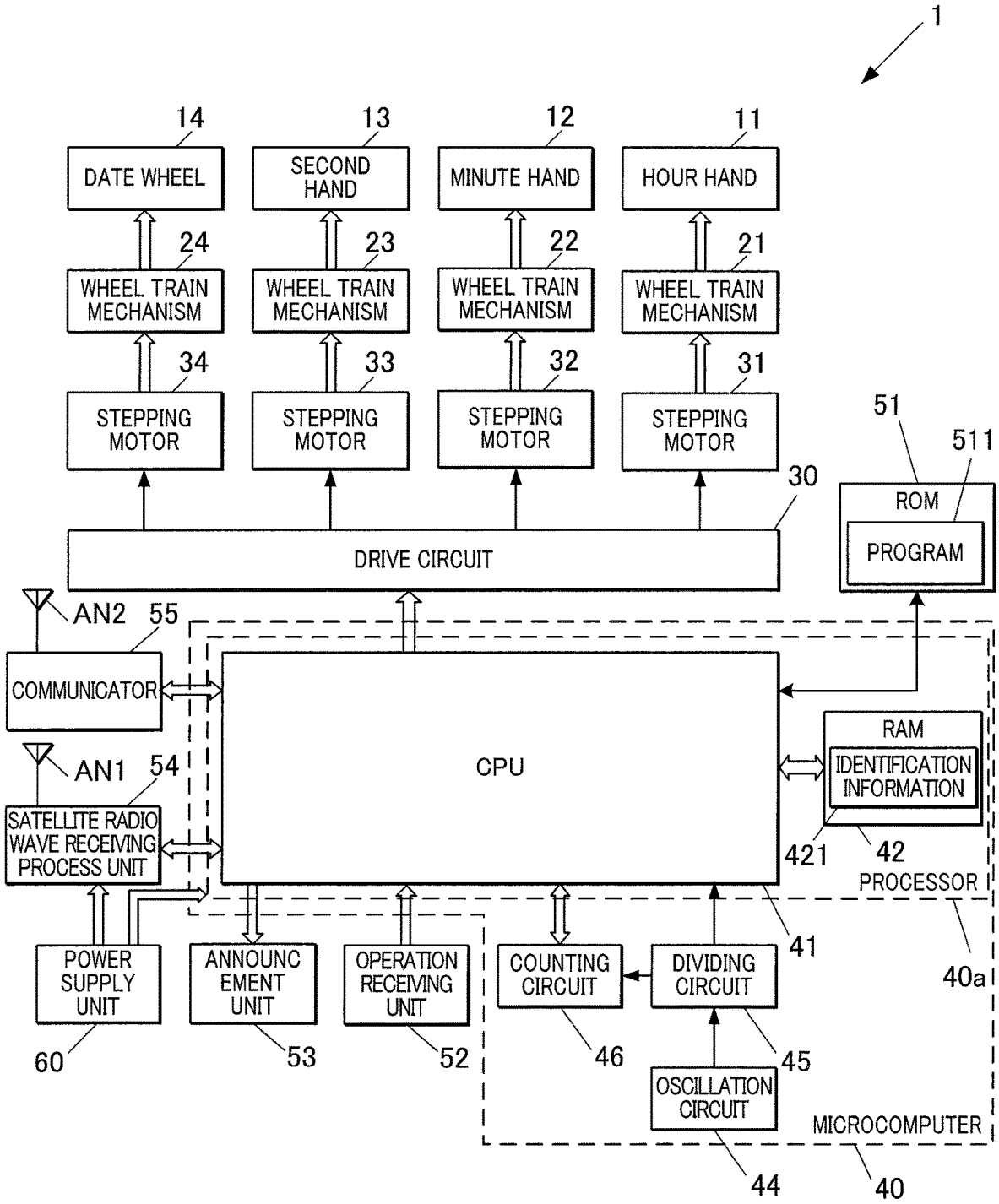
FIG. 2 is a block diagram illustrating a functional configuration of the electronic timepiece.

FIG. 2 is a block diagram illustrating a functional configuration of the electronic timepiece 1 according to the embodiment.

The electronic timepiece 1 includes the hour hand 11, a stepping motor 31 which makes the hour hand 11 rotate via a wheel train mechanism 21, the minute hand 12, a stepping motor 32 which makes the minute hand 12 rotate via a wheel train mechanism 22, the second hand 13, a stepping motor 33 which makes the second hand 13 rotate via a wheel train mechanism 23, the date wheel 14, a stepping motor 34 which makes the date wheel 14 rotate via a wheel train mechanism 24, a drive circuit 30, a microcomputer 40, a ROM (Read Only Memory) 51, an operation receiving unit 52, an announcement unit 53, a satellite radio wave receiving process unit 54 (receiver, satellite radio wave receiver), an antenna AN1, a communicator 55, an antenna AN 2, a power supply unit 60, and the like.

The microcomputer 40 includes a CPU (Central Processing Unit) 41, a RAM (Random Access Memory) 42, an oscillation circuit 44, a dividing circuit 45, a counting circuit 46, and the like.

The CPU 41 and the RAM 42 are included in the processor 40*a* which integrally controls the entire operation of the electronic timepiece 1 according to the embodiment.

The CPU 41 carries out various types of arithmetic processes, obtains signals from individual units as needed, and outputs control signals to the individual units. For example, the CPU 41 outputs control signals to rotate the hour hand 11, the minute hand 12, the second hand 13 and the date wheel 14 (display unit; hereinafter, a part of or all of the hour hand 11, the minute hand 12, the second hand 13 and the date wheel 14 are referred to as the hands 11 to 14 or the like) at arbitrary timings with respect to the drive circuit 30.

The RAM 42 supplies the work memory space for the CPU 41, and temporary data is stored in the RAM 42. The temporary data which is to be stored in the RAM 42 includes setting data, history data and the like according to individual functions. The setting data according to the individual functions includes, for example, the identification information 421 (setting) of an external device with which communication connection is established when communicating with the external device by the communicator 55 through Bluetooth (registered trademark). Further, the history data includes, for example, the closest timing when the date and time information was obtained from outside and information on the type of obtaining.

The oscillation circuit 44 generates a predetermined frequency signal and outputs the signal to the dividing circuit 45. As for the oscillation circuit 44, a crystal oscillator or the like is used, for example. In such case, a crystal oscillator can be externally attached to the microcomputer 40.

The dividing circuit 45 divides the frequency of the predetermined frequency signal which is input from the oscillation circuit 44, generates a signal of the frequency which is set by the control signal from the CPU 41, and outputs the generated signal to the CPU 41. Further, the dividing circuit 45 generates a signal of a predetermined frequency (for example, 1 second signal) and outputs the generated signal to the counting circuit 46.

The counting circuit 46 is a counter which counts the date and time by counting the frequency signal which is input. Alternatively, the counting circuit 46 may be a memory such as a DRAM or the like in which the date and time counted by the CPU 41 in the software-like manner is to be stored.

In the ROM 51, various types of programs 511 which are executed by the processor 40*a* (CPU 41) and initial setting data which is used in the programs 511 are stored. The programs 511 and the initial setting data are read out, executed and used by the CPU 41 when the electronic timepiece 1 is activated or as needed. The ROM 51 may include, in addition to or instead of a mask ROM, various types of non-volatile memories such as a rewritable flash memory, an EEPROM (Electronically Erasable and Programmable Read Only Memory) and the like.

The operation receiving unit 52 detects and receives an input operation from outside, such as an input operation performed by a user, converts the input operation into an electronic signal, and outputs the converted electronic signal to the CPU 41 as an input signal. The operation receiving unit 52 includes the push button switches B1 and B2 and the crown C1 as the operating members. A user can perform an input operation via the push button switches B1 and B2 and the crown C1 to correct the present date and time (time), to carry out positioning, and to carry out operations according to other various types of functions.

The announcement unit 53 carries out a predetermined announcement operation for a user. As for the predetermined announcement operation, for example, generation of buzzer sound, generation of vibration, lighting of a lamp (blinking), and the like can be suggested. The announcement unit 53 includes one or a plurality of configurations corresponding to these operations. For example, with respect to the generation of buzzer sound, a piezoelectric device having electrodes respectively on both ends and a diaphragm are used. With respect to the generation of vibration, for example, a rotating motor with weight is used. Further, with respect to the lighting of a lamp, for example, an LED is used.

The satellite radio wave receiving process unit 54 receives radio waves (broadcast radio waves including time information) from a positioning satellite via the antenna AN1, obtains the date and time or carries out positioning arithmetic, and outputs the outcome to the CPU 41. Although the positioning satellites which are the targets from which the satellite radio wave receiving process unit 54 receives radio waves are the positioning satellites according to the GPS (Global Positioning System) used in the United States of America, for example, radio waves of other positioning satellites can be received and used for carrying out positioning. Here, the CPU, the arithmetic circuit and the like which carry out the positioning arithmetic may be included in the above described processor 40*a*. They can be disposed in the module of the satellite radio wave receiving process unit 54 together with the receiving unit which carries out syntonization, amplification, acquisition, demodulation (reverse spread spectrum) and the like of radio waves. Alternatively, they can also be disposed together with the CPU 41, the RAM 42 and the like.

The communicator 55 carries out communication control for establishing communication connection with an external electronic device (external device) which is set via the antenna AN2 and communicating with each other in a wireless manner. The communicator 55 includes a transmitter and a receiver, transceiver, or other circuit components for performing wireless communication. Although it is not specifically limited, here, the communicator 55 controls the communication according to the Bluetooth protocol. As for the communication through Bluetooth, here, the power saving communication of version 4 can be used, and the power consumption per one communication is not large even when compared to the power consumed in the normal operation of the electronic timepiece 1. Instead of or in addition to this, as for the communication through Bluetooth, the high speed communication of version 3 or other versions may also be used.

The power supply unit 60 supplies required power to the microcomputer 40 in the form of a predetermined operation voltage. Although it is not specifically limited, this power supply unit 60 includes a solar panel and a secondary battery as its battery, for example, and this allows long term and safe power supply. Alternatively, power can be supplied from a primary battery such as a button type dry-cell battery which can be attached to and detached from the power supply unit 60. In the case where the output voltage of the battery and the operation voltage of individual units do not match, the power supply unit 60 converts the voltage and outputs the converted voltage to individual units. Further, with respect to the satellite radio wave receiving process unit 54, the communicator 55 and the like, whether power is to be directly supplied thereto from the power supply unit 60 or not can be switched by the control of the microcomputer 40 (CPU 41).

Each of the stepping motors 31 to 34 is step driven on the basis of the voltage waveform of the drive pulse which is input from the drive circuit 30. In such way, each of the hands 11 to 14 is made to individually rotate by a predetermined angle in the forward direction (in the direction time period and time proceed) or in the reverse direction (in the direction time period and time are reversed). Here, each of these stepping motors 31 to 34 can be driven in the forward direction at the maximum speed of 64 pps (pulse per second) by the drive pulse and can be driven in the reverse direction at the maximum speed of 32 pps by the drive pulse.

The drive circuit 30 outputs drive pulses of various pulse widths which are set for individual stepping motors 31 to 34 on the basis of a control signal according to the operation of the hands 11 to 14 which is output from the CPU 41. This drive circuit 30 is configured so as not to output drive pulses with respect to a plurality of stepping motors at the same time. That is, in the case where hand operation commands to the plurality of hands are input at the same time, the drive circuit 30 outputs the drive pulses to the stepping motors following the order of priority which is set in advance with respect to the hands which are the targets for the hand movement.

In the electronic timepiece 1 of the embodiment, the wheel train mechanisms 21 to 24 are configured so that the hour hand 11 and the minute hand 12 rotate by 1 degree, the second hand 13 rotates by 6 degrees and the date wheel 14 rotate by $1/124$ degrees ($360/(31\times1440)$ degrees) every time the stepping motors 31 to 34 are driven one step. Therefore, in the normal time display mode, operation is controlled so that the second hand 13 rotates 1 step every second according to the input intervals of the drive pulses to the stepping motor 33, the minute hand 12 rotates 1 step every 10 seconds (1:10 in time ratio) at the timing when the second digit be "0" with the movement of the second hand 13, and the hour hand 11 rotates 1 step every two minutes (1:12 in time ratio) at the timing when the minute digit be an even number with the movement of the minute hand 12. The date wheel 14 rotates 1440 steps in a fast forward manner when the date changes, that is, every other timing when the hour hand 11 points at the direction of 12:00 to change the display by one day.

Further, in the case where the date and time correcting operation and the positioning operation are to be carried out, the second hand 13 carries out a display according to the obtained content of the date and time information and the present location information and according to the type of obtaining unit.

Next, the date and time correcting operation carried out in the electronic timepiece 1 according to the embodiment will be described.

With respect to the electronic timepiece 1 of the embodiment, when communication connection is established with an external device through Bluetooth via the communicator 55, the electronic timepiece 1 obtains the date and time information and the present location information (information regarding the present time and information regarding the present location) from the connected external device. The present location information here includes information regarding the position in a broad range such as the time zone, the local time setting area, and the like. With respect to the communication connection with an external device, such connection can be established at an arbitrary timing on the basis of an input operation performed by a user, or further, can be established automatically in order to obtain the date and time information and the present location information once every day or at predetermined times several times a day. The time needed to obtain the date and time information and the present location information from an external device is short and, for example, it is between one second to several seconds and power consumption is small. In order to communicate with an external device through Bluetooth, the identification information of the external device needs to be set and stored in the RAM 42 in advance. As for the external device, portable type electronic terminals which can be readily used with the electronic timepiece 1 such as smartphones, for example, are mainly suggested. However, this is not limitative in any way. The external device may be a fixed terminal or may be various types of servers and the like on the internet circuit.

On the other hand, the electronic timepiece 1 can obtain the date and time information from a positioning satellite by the operation of the satellite radio wave receiving process unit 54 and can identify the present location by carrying out positioning. Further, in the case where positioning is carried out, the local time setting including the time zone, setting of summer time application and the like of the identified present location is also obtained, and the display of date and time can be adjusted. Such obtaining of the date and time information and positioning can be carried out according to an operation performed by a user. Further, in the case where the date and time cannot be obtained through Bluetooth, the electronic timepiece 1 obtains the date and time when the satellite radio wave receiving process unit 54 is activated once a day under a predetermined condition.

In the case where the location information of a positioning satellite from which information can be received is not stored in advance, obtaining of the date and time by the satellite radio wave receiving process unit 54 will require several seconds to about 10 seconds according to a well-known algorithm. Obtaining of the date and time can be carried out anywhere in the world as long as radio waves from any positioning satellite can be received when a user is outside. However, the power consumed during the operation of the satellite radio wave receiving process unit 54 is far greater than the power consumed during the normal operation of the electronic timepiece 1 and during the communication operation through Bluetooth. Further, positioning requires 20 seconds to about 1 minute, and the amount of power consumed will be even greater comparing to obtaining of the date and time depending on the length of time needed for reception and processing time.

Such obtaining operation of date and time information and present location information carried out by the communicator 55 (the first information obtaining operation), obtaining operation of date and time information carried out by the satellite radio wave receiving process unit 54 (the second information obtaining operation), and positioning operation carried out by the satellite radio wave receiving process unit 54 are switched among each other according to an operation received by the push button switch B1. In the electronic timepiece 1 according to the embodiment, selecting is carried out on the basis of whether the identification information (setting) of the external device which is the target with which communication connection through Bluetooth is established exists. In the electronic timepiece 1, a predetermined input operation which is first received is the command for carrying out the operation to obtain date and time information (obtaining command of information regarding the present time) and the communicator 55 (external device) or the satellite radio wave receiving process unit 54 (positioning satellite) is selected as the date and time information obtaining unit (from where information is obtained). Further, the selection can be changed according to an additional input operation or can be changed to positioning operation.

Figure 3:
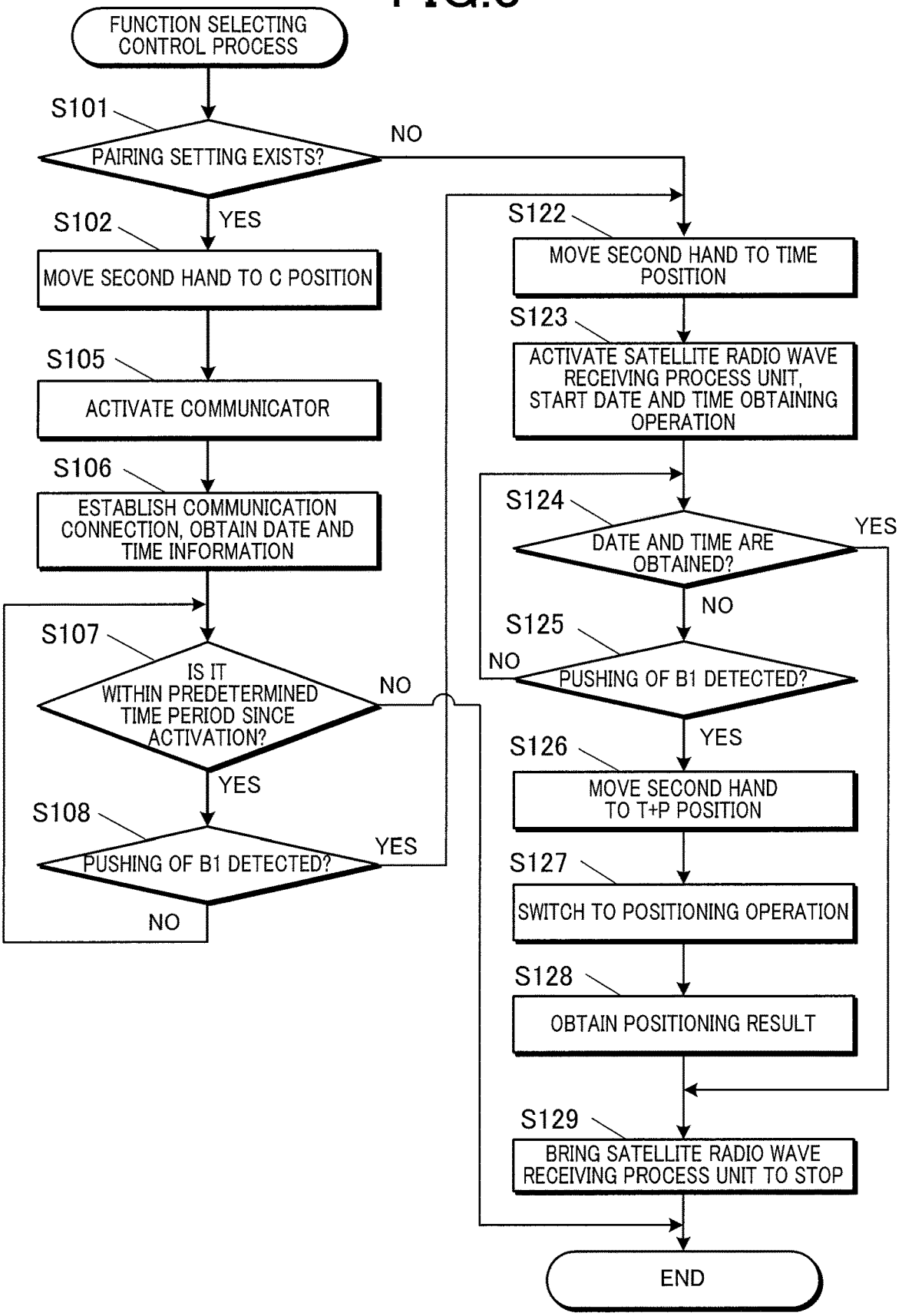
FIG. 3 is a flowchart illustrating a control procedure of a function selecting control process which is executed in the electronic timepiece according to the embodiment.

FIG. 3 is a flowchart illustrating a control procedure which is carried out by the processor 40*a* in a function selecting control process which is executed in the electronic timepiece 1 according to the embodiment.

The function selecting control process which is an embodiment of the information obtaining control method of the present invention starts when the pushing of the push button switch B1 for a predetermined period of time, here, pushing of the push button switch B1 for 1 second (a predetermined input operation) is detected. That is, the function selecting control process starts regardless of whether the pushed state of the push button switch B1 is released or not.

When the function selecting control process starts, the processor 40*a* (CPU 41) determines whether setting (pairing setting) of the target with which communication connection is to be established through Bluetooth is set (step S101). If it is determined that the setting is not set (NO in step S101), the process of the processor 40*a* moves onto step S122.

If it is determined that the pairing setting is set (YES in step S101), the processor 40*a* outputs a control signal to the drive circuit 30 and makes the second hand 13 move to the position of indicator "C" (step S102). The processor 40*a* activates the communicator 55 (step S105). The processor 40*a* establishes communication connection with the external device with which the pairing setting is set through Bluetooth and obtains date and time information (step S106). The processor 40*a* can disconnect the communication connection once the date and time are obtained or the processor 40*a* can further obtain other information with the date and time.

The processor 40*a* determines whether it is within a predetermined time period (the second reference time period) since the communicator 55 is activated (step S107). If it is determined that it is within a predetermined time period (YES in step S107), the processor 40*a* determines whether a pushing operation of the push button switch B1 (normally, this is a pushing operation performed by a user) is detected (an input operation performed on a predetermined operating member is detected again) (step S108). If it is determined that the pushing operation is detected (YES in step S108), the process of the processor 40*a* moves onto step S122. If it is determined that the pushing operation is not detected (NO in step S108), the process of the processor 40*a* returns to step S107.

When moved onto step S122 from the determining processes of steps S101 and S108, the processor 40*a* outputs a control signal to the drive circuit 30 and makes the second hand 13 move to the position of indicator "TIME" (step S122). The processor 40*a* activates the satellite radio wave receiving process unit 54 to start the date and time obtaining operation (step S123). That is, the processor 40*a* makes the satellite radio wave receiving process unit 54 capture radio waves of at least one positioning satellite and makes the satellite radio wave receiving process unit 54 obtain the information required for identifying the date and time from the positioning satellite captured. At this time, the processor 40*a* may disconnect the wireless communication connection with the external device which has been connected by the communicator 55. Further, in the case where the date and time information has already been obtained at this point, the processor 40*a* discards the date and time information. Here, the processor 40*a* may correct the date and time that is counted by the counting circuit 46 by reflecting, once, the date and time information which has been already obtained.

The processor 40*a* determines whether date and time information is obtained from the satellite radio wave receiving process unit 54 (step S124). If it is determined that date and time information is obtained (YES in step S124), the process of the processor 40*a* moves onto step S129. If it is determined that date and time information is not obtained (NO in step S124), the processor 40*a* determines whether the pushing operation of the push button switch B1 is detected (step S125). If it is determined that the pushing operation is not detected (NO in step S125), the process of the processor 40*a* returns to step S124.

If it is determined that the pushing operation of the push button switch B1 is detected (that is, if operation of the push button switch B1 is detected again during the time period between activation of the satellite radio wave receiving process unit 54 and obtaining of the date and time information (during the third reference time period)) (YES in step S125), the processor 40*a* outputs a control signal to the drive circuit 30 and makes the second hand 13 move to the position of indicator "T+P" (step S126). The processor 40*a* outputs a control signal to the satellite radio wave receiving process unit 54 which is in the middle of operation and makes the satellite radio wave receiving process unit 54 move onto the positioning operation from the date and time obtaining operation (step S127). In the case where the satellite radio wave receiving process unit 54 cannot move onto the positioning operation from the date and time obtaining operation, the processor 40*a* may interrupt (terminate) the operation of the satellite radio wave receiving process unit 54 and then restart the date and time obtaining operation. The processor 40*a* obtains the positioning result (that is, information regarding the present time and information regarding the present location) from the satellite radio wave receiving process unit 54 (step S128). Thereafter, the process of the processor 40*a* moves onto step S129.

When moved onto the process of step S129 from the processes of steps S124 and S128, the processor 40*a* bring the operation of the satellite radio wave receiving process unit 54 to a stop (step S129). Thereafter, the processor 40*a* ends the function selecting control process.

In the above described processes, the processes of steps S101, S106 and S123 configure the operation selecting step (operation selecting unit) in the information obtaining control method (program) according to the embodiment.

Figure 4:
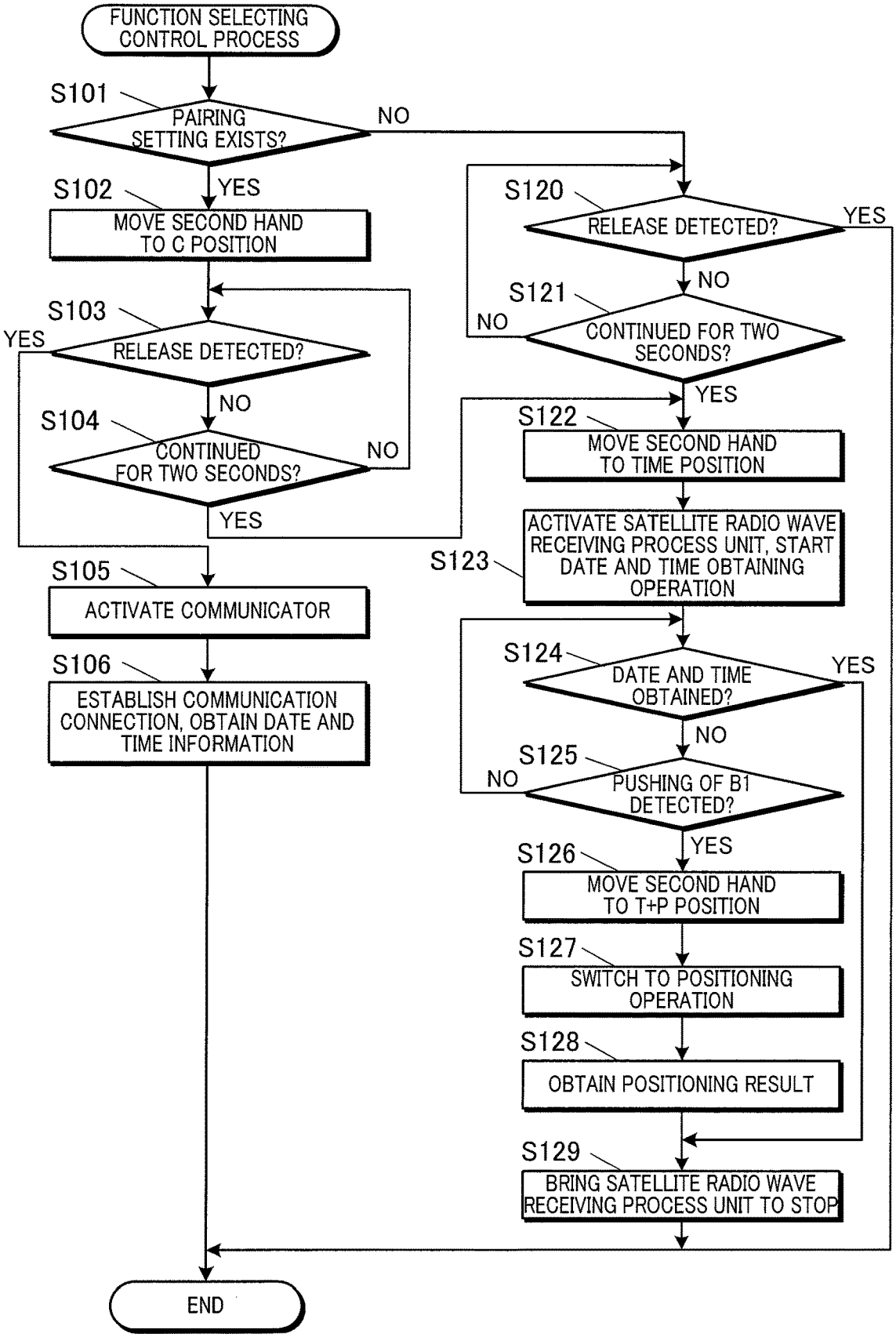
FIG. 4 is a flowchart illustrating the modification example 1 of the function selecting control process.

FIG. 4 is a flowchart illustrating the modification example 1 of the function selecting control process.

Comparing to the function selecting control process shown in FIG. 3, the function selecting control process of the modification example 1 further includes the processes of steps S103, S104, S120 and S121 and the processes of steps S107 and S108 are omitted. Other processing contents are the same, and the same symbols are used for the same processing contents and the detail descriptions thereof are omitted.

If it is determined that the pairing setting is set in the determining process of step S101 (YES in step S101), the processor 40*a* determines whether releasing (release) of the pushed state of the push button switch B1 is detected (step S120). If it is determined that the releasing is not detected (NO in step S120), the processor 40*a* determines whether the pushed state of the push button switch B1 (the duration of predetermined input operation) has been continued for two seconds or longer (the first reference time period) (step S121).

If it is determined that the pushed state has not been continued for two seconds or longer (NO in step S121), the process of the processor 40*a* returns to step S120. If it is determined that the time period of two seconds or longer has elapsed (YES in step S121), the process of the processor 40*a* moves onto step S122. If it is determined that releasing of the pushed state of the push button switch B1 is detected (that is, the pushed state was released in less than two seconds) in the determining process of step S120 (YES in step S120), the processor 40*a* ends the function selecting control process.

Further, after the process of step S102, the processor 40*a* determines whether releasing of the pushed state of the push button switch B1 is detected (step S103). If it is determined that releasing is not detected (NO in step S103), the processor 40*a* determines whether the pushed state of the push button switch B1 (the duration of a predetermined input operation) has been continued for two seconds or longer (the first reference time period) (step S104). If it is determined that the pushed state has not been continued for two seconds or longer (NO in step S104), the process of the processor 40*a* returns to step S103. If it is determined that the time period of two seconds or longer has elapsed (YES in step S104), the process of the processor 40*a* moves onto step S122.

If it is determined that releasing of the pushed state of the push button switch B1 is detected (that is, the pushed state was released in less than two seconds) in the determining process of step S103 (YES in step S103), the process of the processor 40*a* moves onto step S105. After the processes of steps S105 and S106 are carried out, the processor 40*a* ends the function selecting control process.

Figure 5:
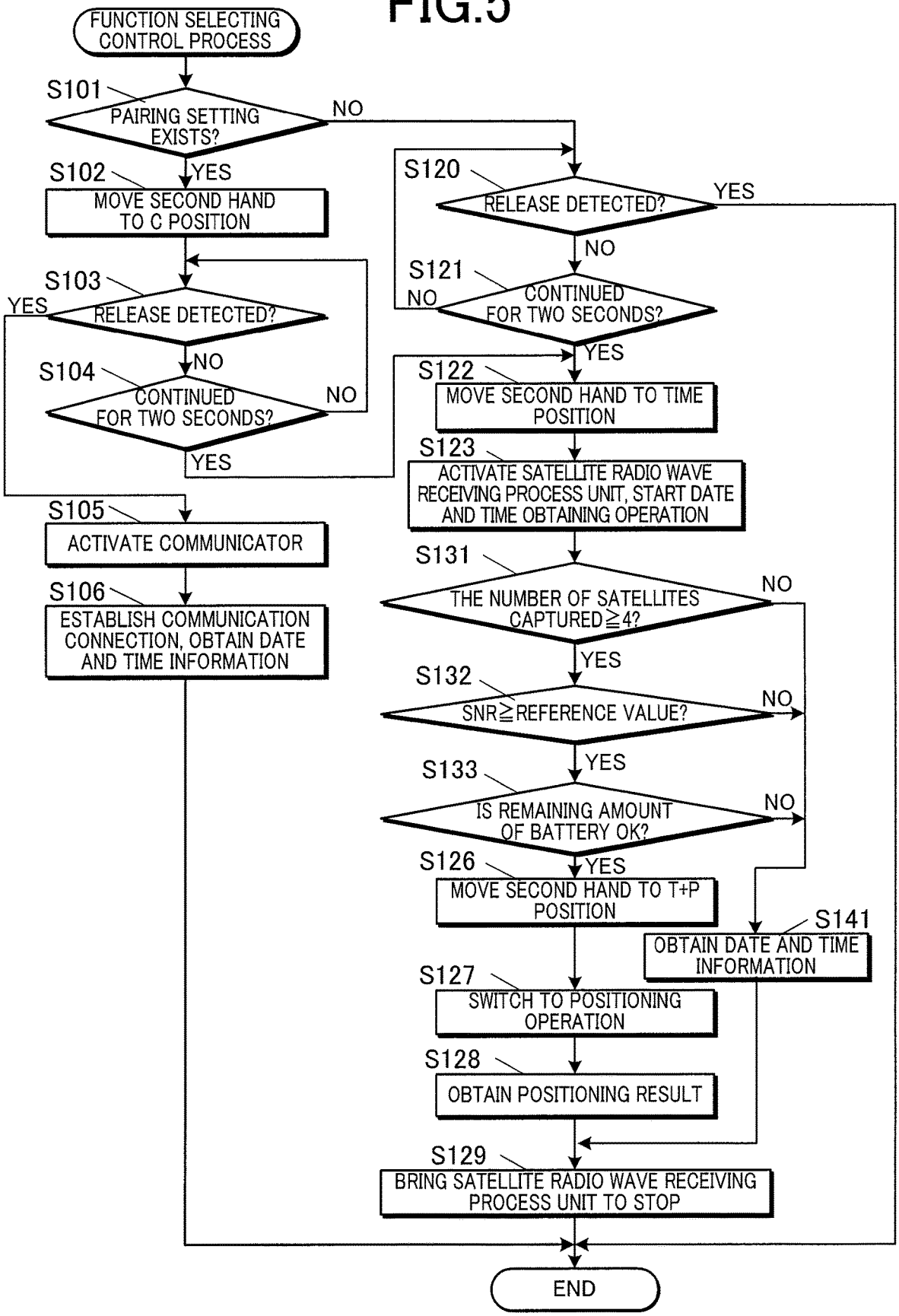
FIG. 5 is a flowchart illustrating the modification example 2 of the function selecting control process.

FIG. 5 is a flowchart illustrating the modification example 2 of the function selecting control process.

Comparing to the function selecting control process shown in FIG. 3, the function selecting control process of the modification example 2 further includes the processes of steps S103, S104, S120, S121, S131 to S133, and S141 and the processes of steps S107, S108, S124 and S125 are omitted. Other processing contents are the same, and the same symbols are used for the same processing contents and the detail descriptions thereof are omitted. Further, the processes of steps S103, S104, S120 and S121 are the same as those in the above described modification example 1, and the descriptions thereof are omitted.

After the process of step S123, the processor 40*a* determines whether the number of positioning satellites captured within a predetermined time period is the number of positioning satellites required for carrying out positioning, that is, whether the number of positioning satellites captured is four or more (three or more in a case where information regarding a height direction is not necessary. The same applies hereianfter) (step S131). If it is determined that the number of positioning satellites captured is not four or more (NO in step S131), the processor 40*a* obtains date and time information from the satellite radio wave receiving process unit 54 (step S141) and then, ends the function selecting control process.

If it is determined that the number of positioning satellites captured is four or more (YES in step S131), the processor 40*a* determines whether the SNRs (reception intensities) of the received signals from four or more positioning satellites among the radio waves from the captured positioning satellites are greater than or equal to a predetermined reference value (step S132). If it is determined that the SNRs of the received signals are not greater than or equal to the reference value (NO in step S132), the process of the processor 40*a* moves onto step S141.

If it is determined that the SNRs are greater than or equal to a reference value (YES in step S132), the processor 40*a* determines whether the remaining amount of battery whose power is supplied from the power supply unit 60 is enough to carry out positioning (OK, whether information regarding the present location can be obtained) (step S133). If it is determined that the remaining amount of battery is not enough (not OK) (NO in step S133), the process of the processor 40*a* moves onto step S141. If it is determined that the remaining amount of battery is enough (YES in step S133), the process of the processor 40*a* moves onto step S126.

Figure 6:
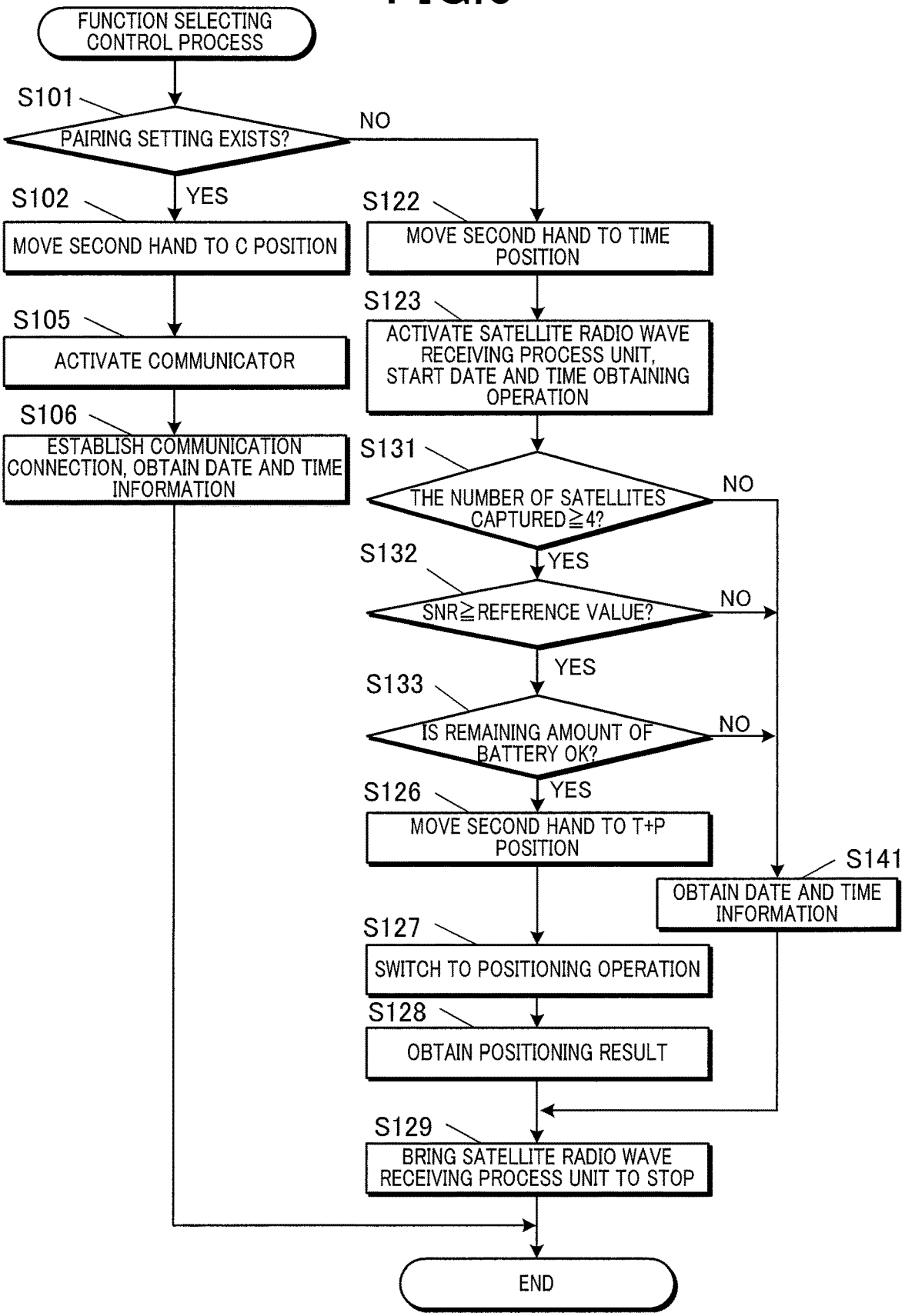
FIG. 6 is a flowchart illustrating the modification example 3 of the function selecting control process.

FIG. 6 is a flowchart illustrating the modification example 3 of the function selecting control process.

Comparing to the function selecting control process shown in FIG. 3, the function selecting control process of the modification example 3 further includes the processes of steps S131 to S133 and S141 and the processes of steps S107, S108, S124 and S125 are omitted. Other processing contents are the same. Further, with respect to the processes of steps S131 to S133 and S141 which are to be carried out instead of the processes of steps S124 and S125, they are the same as those shown in the modification example 2 and thus, the descriptions thereof are omitted.

As described above, the electronic timepiece 1 of the embodiment includes the satellite radio wave receiving process unit 54 which receives broadcast radio waves including date and time information, the communicator 55 which establishes communication connection with an external device whose identification information 421 is set to carry out wireless communication, the processor 40*a* (the CPU 41 and the RAM 42), and the operation receiving unit 52 which receives input operations via the operating members (the push button switches B1 and B2 and the crown C1). When the long push operation corresponding to the command for obtaining the present date and time information is received via the push button switch B1, the processor 40*a* (CPU 41) selects the first information obtaining operation by which the present date and time information is obtained from the set external device via the communicator 55 or the second information obtaining operation by which information is obtained on the basis of broadcast radio waves from a positioning satellite received by the satellite radio wave receiving process unit 54 according to whether the setting of the identification information 421 regarding the external device exists.

In such way, if the identification information 421 is not set, the operation receiving operation relating to receiving of information from an external device is omitted to begin with. Therefore, a user can reach the receiving state of a desired operation more efficiently without stress by skipping the unnecessary determining steps such as checking to see his/her operation is now at which step. Further, in the case where the identification information 421 is set, normally, the date and time can be obtained from the external device in a short time period and in a low power consumption manner. Thus, the date and time correcting operation performed by a user can be carried out more easily.

Therefore, in the electronic timepiece 1, the date and time information can be obtained more flexibly and efficiently.

Furthermore, in the case where the duration of the pushed state of the push button switch B1 has been two seconds (the first reference time period) or longer after the processor 40*a* selected the first information obtaining operation, the processor 40*a* changes the selection to the second information obtaining operation. In such way, even in the case where the electronic timepiece 1 is connected with an external device such as a smartphone but the external device is in the state where it is not nearby or it cannot be used, the electronic timepiece 1 can obtain the date and time information by itself by promptly receiving radio waves from a positioning satellite. Thus, while information is basically received from an external device, a user can easily and flexibly switch the target from where the date and time information is to be obtained according to the situation. Further, in such case, it is sufficient that a user continues to push down the push button switch B1 and thus, the operation can be easily remembered by a user.

Moreover, in the case where the pushing operation of the push button switch B1 is detected again within a predetermined time period after the processor 40*a* selected the first information obtaining operation, the processor 40*a* changes the selection to the second information obtaining operation. In such way, the operation can be easily switched to receiving of radio waves from a positioning satellite by an additional operation after the operation of the communicator 55 has started. Thus, the process is not complicated. Further, since the target from where information is to be received can be switched by performing operation only on the push button switch B1, the user's operation is not complicated.

Moreover, in the first information obtaining operation, information regarding the present time and information regarding the present location are obtained. In such way, if the identification information 421 is set, the date and time information and the present location information can be obtained together by an easy operation and in a short time period. Thus, while maintaining the operation for carrying out radio wave reception from a positioning satellite within the range it does not be complicated, normally, information required for displaying the correct date and time including the local time setting can be obtained easily.

Further, the receiver includes the satellite radio wave receiving process unit 54 which receives radio waves from a positioning satellite.

Due to the date and time information and the present location information being obtainable by using radio waves from a positioning satellite, the electronic timepiece 1 can count and display the correct date and time at anywhere in the world even in the case where an external device such as a smartphone cannot be used.

Furthermore, in the case where the pushing operation of the push button switch B1 is detected again within the time period until the date and time is obtained after the processor 40*a* selected the second information obtaining operation, the processor 40*a* carries out the positioning operation to obtain information regarding the present time and information regarding the present location. In the case where the operation is to be switched to obtaining information including the present location information from obtaining the date and time information when the setting of the identification information 421 of an external device does not exist, such switching can be carried out just by simply pushing the push button switch B1 once more. Thus, the switching operation is not complicated and the burden on a user will not be increased to a great extend.

Moreover, in the case where the processor 40*a* selected the second information obtaining operation, the processor 40*a* determines whether the positioning operation can be carried out on the basis of the remaining amount of the battery which supplies power to the satellite radio wave receiving process unit 54. That is, in the case where there is not enough power remained in the battery to carry out the positioning operation, the positioning operation will not be started. Thus, in the electronic timepiece 1, efficient information obtaining can be carried out by avoiding unnecessary power consumption and by preventing the waiting time of a user from becoming long.

Further, in the case where the processor 40*a* selected the second information obtaining operation, the processor 40*a* makes the satellite radio wave receiving process unit 54 operate and determines whether the positioning operation can be carried out on the basis of at least one of the number of positioning satellites captured by the satellite radio wave receiving process unit 54 and the SNRs thereof. That is, in the case where the environment does not allow the electronic timepiece 1 to easily and reliably carry out the positioning, the positioning operation will not be carried out in the electronic timepiece 1. Thus, in the electronic timepiece 1, information can be obtained in an efficient manner by avoiding unnecessary power consumption and by preventing the waiting time of a user from becoming long.

Furthermore, the electronic timepiece 1 is provided with the hands 11 to 14 (especially, the second hand 13) which display the type of information obtaining operation which is selected on the basis of the control of the processor 40*a*. In such way, the electronic timepiece 1 can easily make a user be aware of which operation is being carried out.

Moreover, the information obtaining control method of the embodiment includes the operation selecting step in which information is obtained by selecting the first information obtaining operation by which information is obtained from the external device which is set in the identification information 421 via the communicator 55 or the second information obtaining operation by which information is obtained on the basis of broadcast radio waves from a positioning satellite received by the satellite radio wave receiving process unit 54 according to whether the setting regarding the external device exists in the case where the long push operation corresponding to the command for obtaining the present time information is received via the push button switch B1.

In such way, by selecting the target from where information is to be obtained according to whether the setting of the identification information 421 exists, the date and time information is obtained from the external device from which the required information can be obtained easily in a short time period if the identification information 421 is set, and the date and time information is obtained by receiving the broadcast radio waves from which the similar information can be obtained independently without using the external device if the identification information 421 is not set. Thus, while preventing a user from performing a complicated process, preventing the waiting time from becoming unnecessarily long and preventing unnecessary power consumption, the date and time information can be obtained more easily and in more efficient manner.

Further, the program 511 of the embodiment makes the computer (the processor 40*a*) of the electronic timepiece 1 function as the operation selecting unit which selects the first information obtaining operation by which information is obtained from the external device which is set in the identification information 421 via the communicator 55 or the second information obtaining operation by which information is obtained on the basis of broadcast radio waves from a positioning satellite received by the satellite radio wave receiving process unit 54 according to whether the setting of the identification information 421 regarding the external device exists in the case where the long push operation corresponding to the command for obtaining the present time information is received via the push button switch B1.

By installing such program 511 and carrying out the operation control in the software-like manner to efficiently obtain date and time information, obtaining of date and time information can be controlled easily in an efficient manner in the electronic timepiece 1 without complicating the circuit size and the like.

Here, the present invention is not limited to the above described embodiment and various modifications can be carried out.

For example, in the above embodiment, description is given by using radio waves from a positioning satellite as an example of broadcast radio waves including time information. However, other broadcast radio waves such as standard radio waves of low frequency band may be included.

Further, in the above embodiment, the communicator 55 carries out communication through Bluetooth. However, this is not limitative in any way as long as the configuration allows to carry out sending and receiving with the set target with which communication connection is established. For example, a wireless LAN or the like may be used.

Furthermore, the external device which is set in the identification information 421 is not limited to one device. A plurality of external devices can be set, and in such case, the obtaining operation of date and time information may be carried out in a predetermined order with respect to the plurality of external devices. Moreover, one external device may be the target with which communication connection is established through Bluetooth and another external device may be the target with which communication connection is established through other ways of communication such as a wireless LAN or the like. In the case where no external device is set, radio wave reception from a positioning satellite will be carried out.

Further, in the above described embodiment, the present location information is inevitably obtained with the date and time information when information is obtained from the external device through Bluetooth via the communicator 55. However, the present location information does not need to be obtained together with the date and time information. The present location information may be not obtained or the selection may be changed so as to also obtain the date and time information according to the pushed state of the push button switch B1 similarly to the case where the operation is switched to the positioning operation from the obtaining of date and time by the satellite radio wave receiving process unit 54.

Furthermore, in the above described embodiment, information regarding time zone, area where summer time is applied and the like is to be obtained as the present location information in the case where communication through Bluetooth is to be carried out. However, an external device, especially, a portable type electronic terminal such as a smartphone which is connected with the electronic timepiece 1 by a short distance wireless communication may be made to carry out the positioning operation to obtain the positioning result.

Moreover, in the above described embodiment, whether to execute positioning is determined by judging all of remaining amount of battery, the number of satellites captured and the intensities of the radio waves received from the satellites captured. However, the determination can be carried out based on one or two of the above aspects (for example, one of the number of positioning satellites captured and the SNRs) or another reference for determination can be applied together. Further, here, positioning is executed automatically in the case where the positioning is executable. However, the configuration may be such that a user's operation to allow switching to the positioning operation or a user's operation to cancel switching to the positioning operation can be received. In both cases, if a user's operation is not performed within a predetermined time period, the processor 40*a* can control so as not to switch the operation to the positioning operation or to switch the operation to the positioning operation according to the basic setting.

Furthermore, in the above described embodiment, the description is given by taking a hand indicating type analog electronic timepiece provided with the hands 11 to 14 as the display unit as an example. However, in addition or instead of such electronic timepiece, the present invention may be an electronic timepiece provided with a digital display screen.

Further, in the above described embodiment, the ROM 51 which includes various types of nonvolatile memories such as a flash memory, an EEPROM and the like is exemplified and described as the computer readable medium of the program 511 of the function selecting control process according to the processing operation of the processor 40*a* (CPU 41) of the present invention. However, the present invention is not limited to such example in any way. As for other computer readable media, an HDD (hard disk drive), a portable-type storage medium such as a CD-ROM, a DVD disk or the like can be used. Furthermore, as for a medium for providing data related to a program via a communication circuit according to the present invention, a carrier wave can be used in the present invention.

Moreover, the contents of the various types of processes shown in the embodiment and modification examples can be executed in combinations, as needed, as long as they do not conflict with each other or cancel out the advantages.

In addition, the specific details such as the configurations, contents and procedures of the controlling and the like shown in the above described embodiment can be modified as needed within the scope of the present invention.

Although several embodiments of the present invention are described, the scope of the present invention is not limited to the above described embodiments and includes the scope of the present invention that is described in the claims and the equivalents thereof.

The entire disclosure of Japanese Patent Application No. 2017-034396 filed on Feb. 27, 2017 including description, claims, drawings, and abstract are incorporated herein by reference in its entirety.

What is claimed is:

1. An electronic timepiece, comprising:

a receiver configured to receive broadcast radio waves including time information;

a communicator configured to carry out wireless communication to receive signals of a different type from the broadcast radio waves by establishing communication connection with an external device; and a processor configured to:

in response to receiving, via a predetermined operating member, a predetermined input operation corresponding to a command for obtaining information regarding a present time, determine whether a setting to identify the external device as a target with which communication connection is to be established exists;

in response to determining the setting to identify the external device as the target with which communication connection is to be established exists, select a first information obtaining operation by which the information regarding the present time is obtained from the external device via the communicator; and in response to determining the setting to identify the external device as the target with which communication connection is to be established does not exist, select a second information obtaining operation by which the information regarding the present time is obtained based on the broadcast radio waves received by the receiver.

2. The electronic timepiece of claim 1, wherein the processor is configured to:

determine whether a duration of the predetermined input operation is longer than or equal to a first reference time period after the processor selects the first information obtaining operation; and in response to determining that the duration of the predetermined input operation is longer than or equal to the first reference time period, change a selection to the second information obtaining operation.

3. The electronic timepiece of claim 2, wherein in the first information obtaining operation, the information regarding the present time and information regarding a present location are obtained.

4. The electronic timepiece of claim 2, wherein the receiver comprises a satellite radio wave receiver configured to receive the broadcast radio waves including the time information from a positioning satellite.

5. The electronic timepiece of claim 4, wherein the processor is configured to:

determine whether the predetermined input operation performed on the predetermined operating member is detected again within a third reference time period after the processor selects the second information obtaining operation; and in response to determining that the predetermined input operation performed on the predetermined operating member is detected again within the third reference time period after the processor selects the second information obtaining operation, carry out a positioning operation to obtain the information regarding the present time and information regarding a present location.

6. The electronic timepiece of claim 1, wherein the processor is configured to:

determine whether the predetermined input operation performed on the predetermined operating member is detected again within a second reference time period after the processor selects the first information obtaining operation; and in response to determining that the predetermined input operation performed on the predetermined operating member is detected again within the second reference time period, change a selection to the second information obtaining operation.

7. The electronic timepiece of claim 6, wherein in the first information obtaining operation, the information regarding the present time and information regarding a present location are obtained.

8. The electronic timepiece of claim 6, wherein the receiver comprises a satellite radio wave receiver configured to receive the broadcast radio waves including the time information from a positioning satellite.

9. The electronic timepiece of claim 8, wherein the processor is configured to:

determine whether the predetermined input operation performed on the predetermined operating member is detected again within a third reference time period after the processor selects the second information obtaining operation; and in response to determining that the predetermined input operation performed on the predetermined operating member is detected again within the third reference time period after the processor selects the second information obtaining operation, carry out a positioning operation to obtain the information regarding the present time and information regarding a present location.

10. The electronic timepiece of claim 1, wherein in the first information obtaining operation, the information regarding the present time and information regarding a present location are obtained.

11. The electronic timepiece of claim 10, wherein the receiver comprises a satellite radio wave receiver configured to receive the broadcast radio waves from a positioning satellite.

12. The electronic timepiece of claim 11, wherein the processor is configured to:

determine whether in a case where the predetermined input operation performed on the predetermined operating member is detected again within a third reference time period after the processor selects the second information obtaining operation; and in response to determining that the predetermined input operation performed on the predetermined operating member is detected again within the third reference time period after the processor selects the second information obtaining operation, carry out a positioning operation to obtain the information regarding the present time and information regarding a present location.

13. The electronic timepiece of claim 1, wherein the receiver comprises a satellite radio wave receiver configured to receive the broadcast radio waves including the time information from a positioning satellite.

14. The electronic timepiece of claim 13,
wherein the processor is configured to:
determine whether the predetermined input operation performed on the predetermined operating member is detected again within a third reference time period after the processor selects the second information obtaining operation; and
in response to determining that the predetermined input operation performed on the predetermined operating member is detected again within the third reference time period after the processor selects the second information obtaining operation, carry out a positioning operation to obtain the information regarding the present time and information regarding a present location.

15. The electronic timepiece of claim 14,
wherein the processor is configured to:
determine a remaining amount of a battery which supplies power to the receiver; and
in response to selecting the second information obtaining operation, determine whether the positioning operation can be carried out, based on the remaining amount of the battery which supplies power to the receiver.

16. The electronic timepiece of claim 15,
wherein the processor is configured to, in response to selecting the second information obtaining operation:
determine whether the positioning operation can be carried out based on at least one of a number of a positioning satellite captured by the satellite radio wave receiver and a reception intensity; and
in response to determining that the positioning operation can be carried out, carry out the positioning operation.

17. The electronic timepiece of claim 14,
wherein the processor is configured to, in response to selectin the second information obtaining operation:
determine whether the positioning operation can be carried out based on at least one of a number of a positioning satellite captured by the satellite radio wave receiver and a reception intensity; and
in response to determining that the positioning operation can be carried out, carry out the positioning operation.

18. The electronic timepiece of claim 1, further comprising a display configured to display information identifying which of the first information obtaining operation and the second information obtaining operation is selected.

19. An information obtaining control method of an electronic timepiece including a receiver which receives broadcast radio waves including time information, and a communicator which carries out wireless communication to receive signals of a different type from the broadcast radio waves by establishing communication connection with an external device, the information obtaining control method comprising:
in response to receiving, via a predetermined operating member, a predetermined input operation corresponding to a command for obtaining information regarding a present time, determining whether a setting to identify the external device as a target with which communication connection is to be established exists;
in response to determining the setting to identify the external device as the target with which communication connection is to be established exists, selecting a first information obtaining operation by which the information regarding the present time is obtained from the external device via the communicator; and
in response to determining the setting to identify the external device as the target with which communication connection is to be established does not exist, selecting a second information obtaining operation by which the information regarding the present time is obtained based on the broadcast radio waves received by the receiver.

20. A non-transitory storage medium for controlling an electronic timepiece including a receiver which receives broadcast radio waves including time information, a communicator which carries out wireless communication to receive signals of a different type from the broadcast radio waves by establishing communication connection with an external device, and a computer, wherein the non-transitory storage medium stores a program which is readable by the computer to cause the computer to at least perform:
in response to receiving, via a predetermined operating member, a predetermined input operation corresponding to a command for obtaining information regarding a present time, determining whether a setting to identify the external device as a target with which communication connection is to be established exists;
in response to determining the setting to identify the external device as the target with which communication connection is to be established exists, selecting a first information obtaining operation by which the information regarding the present time is obtained from the external device via the communicator; and
in response to determining the setting to identify the external device as the target with which communication connection is to be established does not exist, selecting a second information obtaining operation by which the information regarding the present time is obtained based on the broadcast radio waves received by the receiver.

* * * * *